US005508583A

United States Patent [19]

Lee

[11] Patent Number: 5,508,583

[45] Date of Patent: Apr. 16, 1996

[54] CATHODE SUPPORT STRUCTURE FOR MAGNETRON

[75] Inventor: Gye-Hong Lee, Songtan, Rep. of Korea

[73] Assignee: Samsung Electronics Co., Ltd., Suwon, Rep. of Korea

[21] Appl. No.: 437,560

[22] Filed: May 9, 1995

Related U.S. Application Data

[63] Continuation of Ser. No. 95,529, Jul. 26, 1993, abandoned.

[30] Foreign Application Priority Data

Jul. 28, 1992 [KR] Rep. of Korea ..... 92-13523

[51] Int. Cl.[6] ..... H01J 29/46

[52] U.S. Cl. ..... 313/446; 315/39.51

[58] Field of Search ..... 313/446

[56] References Cited

U.S. PATENT DOCUMENTS

| | | | |
|---|---|---|---|
| 3,588,588 | 6/1971 | Numata | 315/39.53 |
| 3,988,636 | 10/1976 | Sato et al. | 315/39.51 |
| 4,066,928 | 1/1978 | Van Bessouw et al. | 315/39.51 |
| 4,207,496 | 6/1980 | Nakai | 315/39.53 |
| 4,230,968 | 10/1980 | Oguro | 315/39.51 |
| 4,296,355 | 10/1981 | Fukatsu et al. | 315/39.51 |
| 4,310,786 | 1/1982 | Kumpher et al. | 315/39.51 |
| 4,426,601 | 1/1984 | Tsuzurahara | 315/39.51 |
| 4,558,250 | 12/1985 | Tsuzurabara | 313/337 |
| 4,705,989 | 11/1987 | Takada et al. | 315/39.51 |
| 4,733,124 | 3/1988 | Oguro et al. | 313/341 |
| 4,862,031 | 8/1989 | Oguro | 313/341 |

FOREIGN PATENT DOCUMENTS 62-76241 4/1987 Japan .

*Primary Examiner*—Donald J. Yusko
*Assistant Examiner*—Lawrence D. Richardson
*Attorney, Agent, or Firm*—Burns, Doane, Swecker & Mathis

[57] ABSTRACT

A cathode structure for a magnetron used in a microwave oven comprises a straight central cathode support rod which extends through both a lower end cap and a filament cathode, and which is fixed to an upper end cap. An outer cathode support rod extends parallel to the central cathode support rod and has an upper end fixed to the lower end cap. A ceramic stem is formed with (i) an outer holding hole for fixing a lower end of the outer cathode support rod, (ii) a central holding hole for fixing a lower end of the central cathode support rod, and (iii) an annular groove. A conductive metal plate is fixed to the upper surface of the ceramic stem for connecting the central cathode support rod to a first outer connecting lead. A conductive terminal plate has an outer end fixed to the upper surface of the ceramic stem and an inner end bent upwardly and spaced from the upper surface of the ceramic stem for connecting electrically the central cathode support rod to a second outer connecting lead and for supporting the central cathode support rod.

9 Claims, 6 Drawing Sheets

CATHODE SUPPORT STRUCTURE FOR MAGNETRON

This application is a continuation of application Ser. No. 08/095,529, filed Jul. 26, 1993, now abandoned.

BACKGROUND OF THE INVENTION

1. Field of the Invention

The present invention relate's to a magnetron for use in a microwave heating instrument such as a microwave oven, and more particularly to an improved cathode support structure for a magnetron.

2. Description of the Prior Art

An example of a conventional cathode support structure for a magnetron is disclosed in Japanese Patent Application Laid-open No. Sho 62-76241, in the above Application, in order to enhance a productivity and a reliability, a metallic layer is deposited on an upper surface of a ceramic stem to which cathode support rods are to be fixed. An upper surface of the ceramic stem to which a metal sleeve is to be fixed is adapted to be lower than the metallic layer to be fixed to the cathode support rods, and is deposited with a metallic layer.

With the above-constructed cathode structure, although it is possible to improve a productivity and a reliability of the magnetron, long lengths of the cathode support rods cause a production cost of the magnetron to be increased due to its expensive molybdenum. Also, a vibration of the cathode structure is hard to be reduced because of the long cathode support rods.

Another conventional cathode support structure for resolving the above problems is illustrated in FIG. 1. As shown in the drawing, a coiled filament cathode 1 made of thorium and molybdenum is fixed at its both ends to a pair of end caps 2 and 3, which are made of molybdenum. A cathode support rod 5 made of molybdenum is passed through the coiled filament cathode 1 without being in contact with the filament cathode 1 and is fixed at its upper end to the upper end cap 2.

A cathode support rod 4 made of the same material as that of the cathode support rod 5 is fixed to the lower end cap 3. The other ends of the cathode support rods 4 and 5 are passed through holes formed fin an insulating ceramic stem 7 constituting a part of the cathode support structure and electrically connected to terminal strips 8 and 9 by using a brazing.

The lower ends of the cathode support rods 4 and 5 are brazed to the terminal strips 8 and 9 which are fused to a metallic layer 7B deposited on a bottom surface of the ceramic stem 7. A circumference 7D around a recess 7C formed in a top of the ceramic stem 7 is also deposited with a metallic layer. A metal sleeve 6 is hermetically fused to the circumference 7D. Pole pieces and a cylindrical anode (not shown) are hermetically fused to a flange portion *6a* of the metal sleeve 6.

However, in the above-mentioned cathode support structure for a magnetron, since a length "l" of the cathode support rod 5 spanning between its lower fused end and the upper end cap 2 is fairly long, a production cost of the cathode support rods and thus the magnetron is increased because the cathode support rods are made of expensive molybdenum material.

Also, when the magnetron i s subjected to an external impact, the fragile filament cathode is easily damaged because an amplitude of vibration generating from the upper end of the cathode support rod, and thus from, the upper end cap 2, is high.

Furthermore, when the pair of cathode support rods 4 and 5 inserted through the ceramic stem 7 are assembled with the terminal strips 8 and 9, respectively, the assembling operation is considerably complicated since the terminal strips are small and the cathode support rods are assembled within the recess formed in the ceramic stem 7.

In addition, in case of the above-mentioned cathode support structure for a magnetron, when an axis of the filament cathode 1 made of thorium-tungsten alloy does not coincide with an axis of the cylindrical anode (not shown), an increased current loss occurs due to leakage into an region adjacent to the filament cathode 1 and anode vanes, which does not contribute to oscillation. This causes oscillation efficiency deteriorate.

For this reason, since the distribution of thermions emitted from the filament cathode 1 is not uniform and thus the thermions concentrate in the region adjacent to the anode vanes, uneven electrical energy is applied to a plurality of resonators defined by the anode vanes, thereby causing microwave output to be decreased.

Also, temperature of the filament cathode 1 adjacent to the region in which the thermions concentrate is rapidly increased, so that the thorium inside the filament cathode 1 which is necessary to emit the thermions is rapidly vaporized. Hence, thermion emitting ability of the filament cathode 1 is rapidly decreased, shortening the service life of the magnetron.

Furthermore, since dimension error of the cathode support rod 5 may occur when the cathode support rod 5 is bent at its two positions, that is, at portions of circle A and circle B in FIG. 1, the cathode support rod 5 is difficult to be precisely located in the axis of the filament cathode 1 after the cathode structure is assembled. Accordingly, the cathode structure deviates from an axis of the cylindrical anode, so that an efficiency and an output as well as a service life of the magnetron is decreased.

In order to overcome the above problems by adjusting the position of the cathode support rod 5 after assembly of the cathode structure, a production cost is increased because of the additional adjusting operation.

SUMMARY OF THE INVENTION

The present invention has been made in view of the above-described problems occurring in the prior art and an object of the invention is to provide a cathode support structure for a magnetron in which cathode support rods made of expensive molybdenum are as short as possible in order to reduce its production cost, and in which a cathode structure is precisely and concentrically positioned in an axis of a cylindrical anode so that oscillation efficiency of a magnetron and resistibility against vibration are improved.

Another object of the present invention is to provide a cathode support structure for a magnetron which can improve efficiency and output of a magnetron and reduce its production cost.

Still another object of the present invention is a cathode support structure being easy to be assembled.

In accordance with the present invention, the object mentioned above can be accomplished by providing a cathode support structure for a magnetron comprising: a straight central cathode support rod passed through a lower end cap and a filament cathode and fixed to an upper end cap at its upper end; an outer cathode support rod extended parallel to the central cathode support rod and fixed to the lower end cap at its upper end to support it; a ceramic stem formed at its upper surface with an outer holding hole for fixing a lower end of the outer cathode support rod and a central holding hole having an upper counterbore for fixing a lower end of the central cathode support rod and formed with an annular groove at a circumference portion of the upper surface; a conductive metal plate fixed to the upper surface of the ceramic stem for connecting the central cathode support rod to a first outer connecting lead; and a conductive terminal plate having an outer end fixed to the upper surface of the ceramic stem and an inner end bent upwardly and spaced from the upper surface of the ceramic stem by a predetermined distance for connecting electrically the central cathode support rod to a second outer connecting lead and supporting the central cathode support rod.

According to the invention, the outer and central cathode support rods made of expensive molybdenum for positioning the filament cathode can be shorted, so that a production cost of the cathode support rods and thus the magnetron is reduced.

Since the outer and central cathode support rods are short and the central cathode support rod is supported by the conductive terminal plate at a position spaced from the ceramic stem by the predetermined distance, a vibration of the cathode structure including the filament cathode is prevented, thereby enhancing durability against vibration.

Also, since the cathode structure can be easily and precisely positioned on an axis of a cylindrical anode, an efficiency and an output of magnetron is enhanced.

Furthermore, since the outer and central cathode support rods has a straight shape different from the prior art, the central cathode support rod is not necessary to be bent at its two position of a middle portion. Accordingly, it is not necessary to adjust a position of the cathode support rod after assembly of the cathode structure, thereby reducing a production cost.

BRIEF DESCRIPTION OF THE DRAWINGS

Other objects and aspects of the invention will be become apparent from the following description of embodiments with reference to the accompanying drawings in which.

DETAILED DESCRIPTION OF THE PREFERRED EMBODIMENTS

Figure 1:
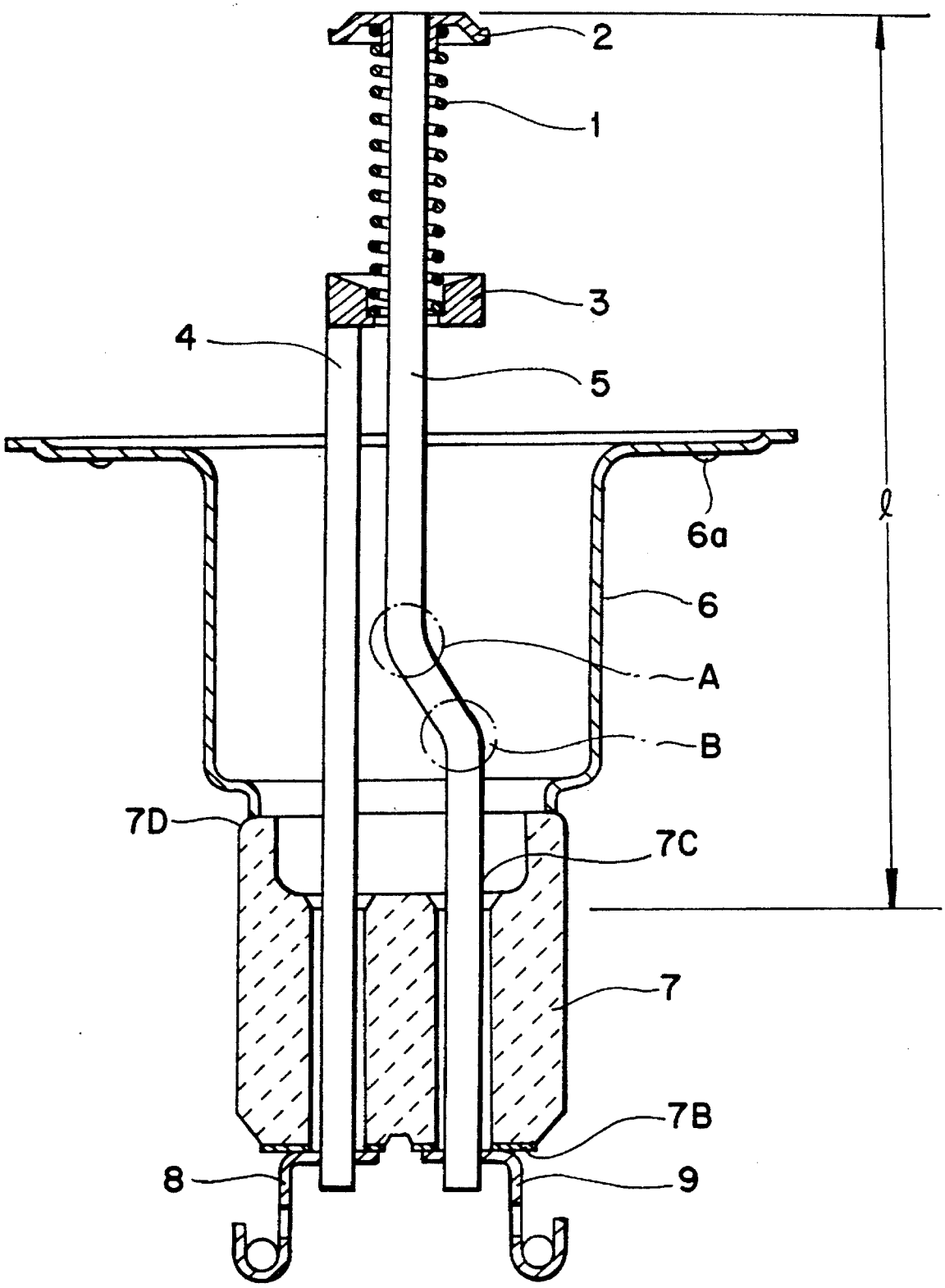
FIG. 1 (PRIOR ART)
FIG. 1 is a vertical sectional view of a conventional cathode support structure for a magnetron.

A cathode support structure according to an embodiment of the present invention will now be described by referring to the accompanying drawings. In these drawings, parts corresponding to those of FIG. 1 are designated by the same numerals and thus description thereof will be omitted.

Figure 2:
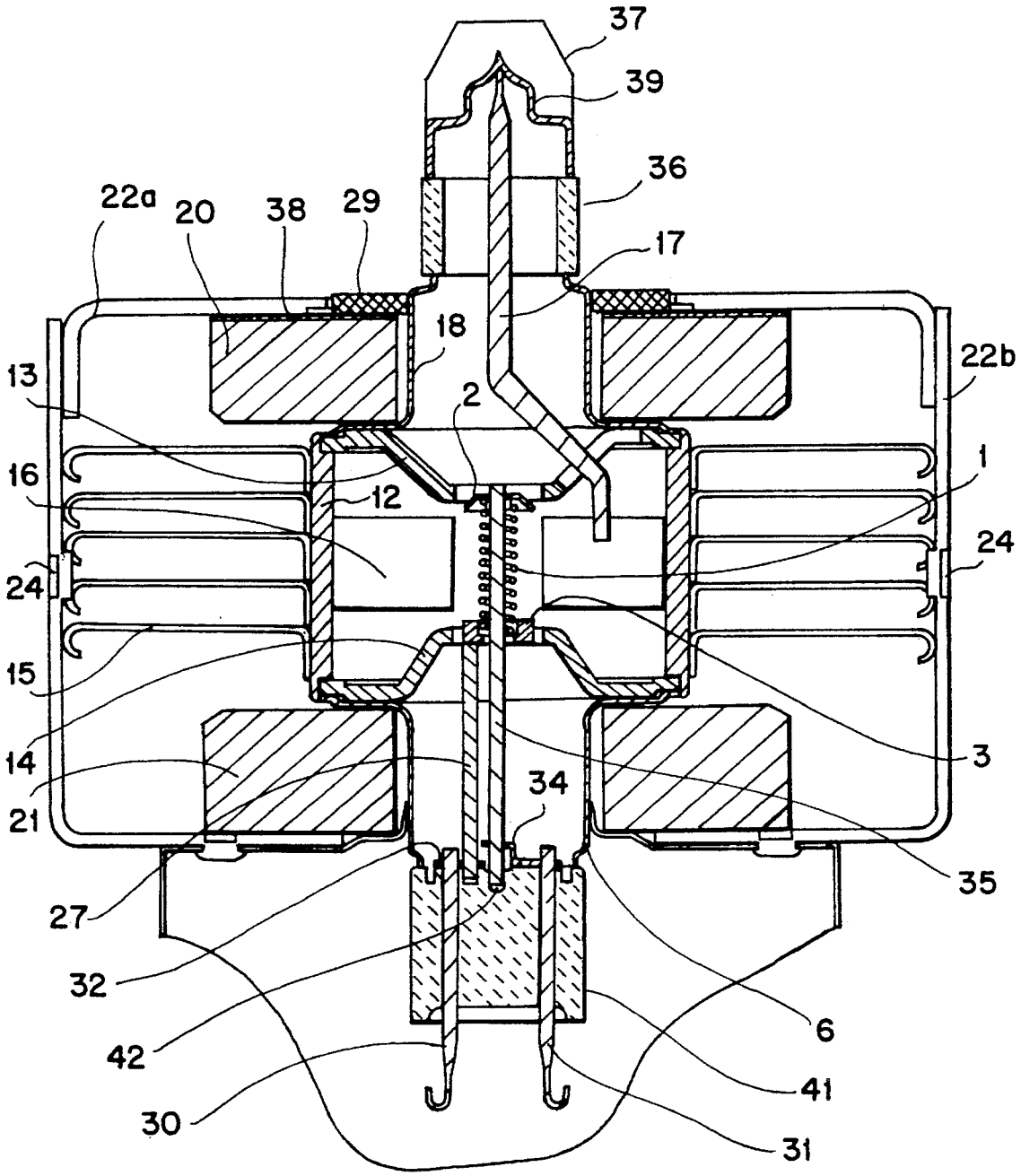
FIG. 2 is a vertical sectional view of a cathode support structure for a magnetron according to an embodiment of the present invention.
Figure 3A:
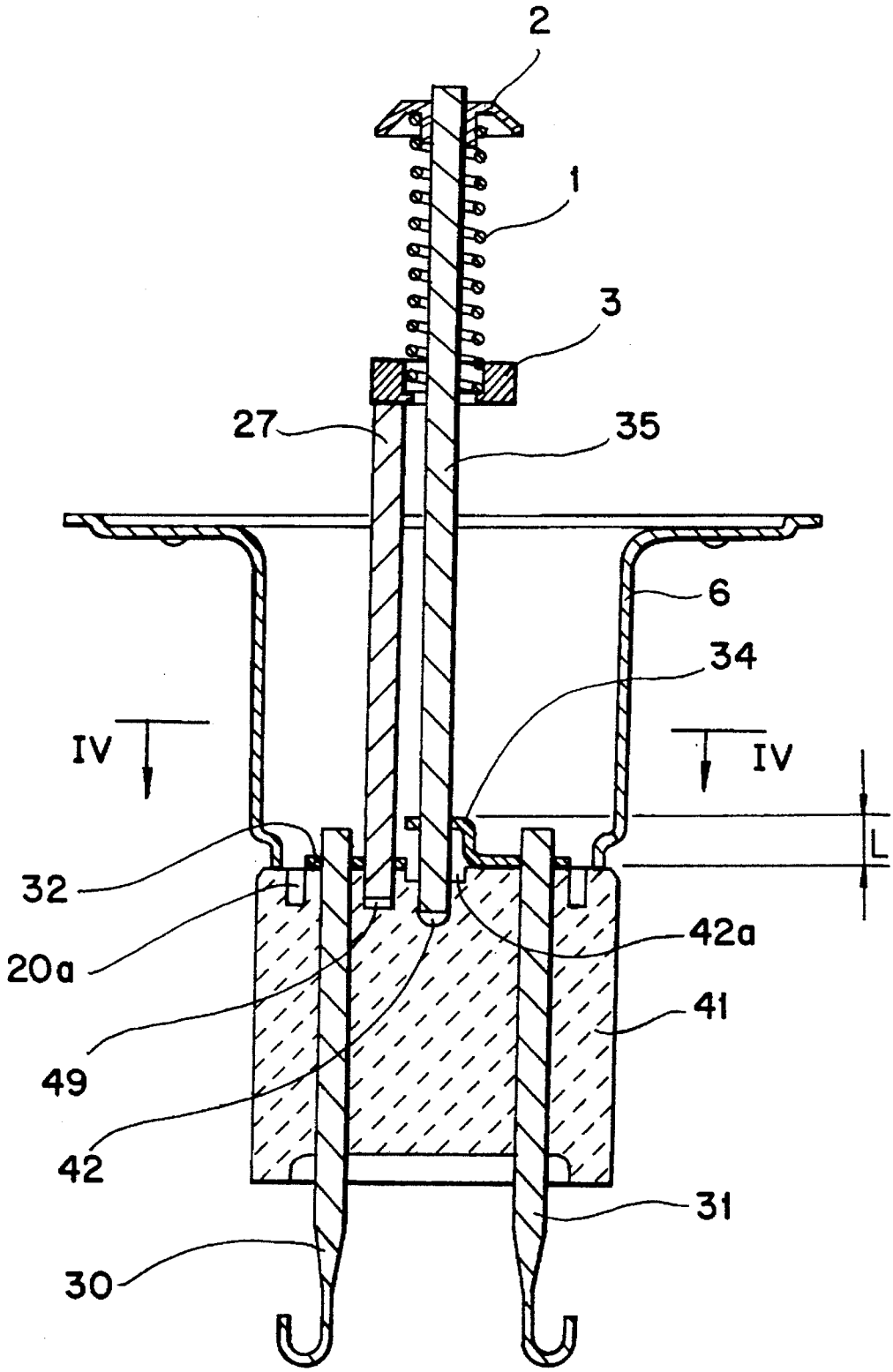
FIG. 3A is an enlarged sectional view of a cathode support structure in FIG. 2.
Figure 3B:
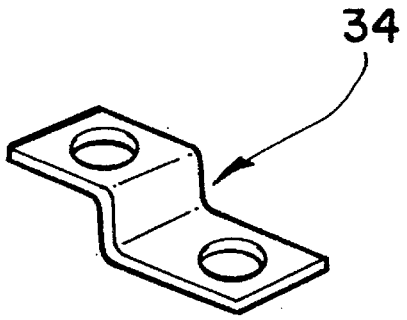
FIG. 3B is an enlarged perspective view of a conductive terminal plate.
Figure 4:
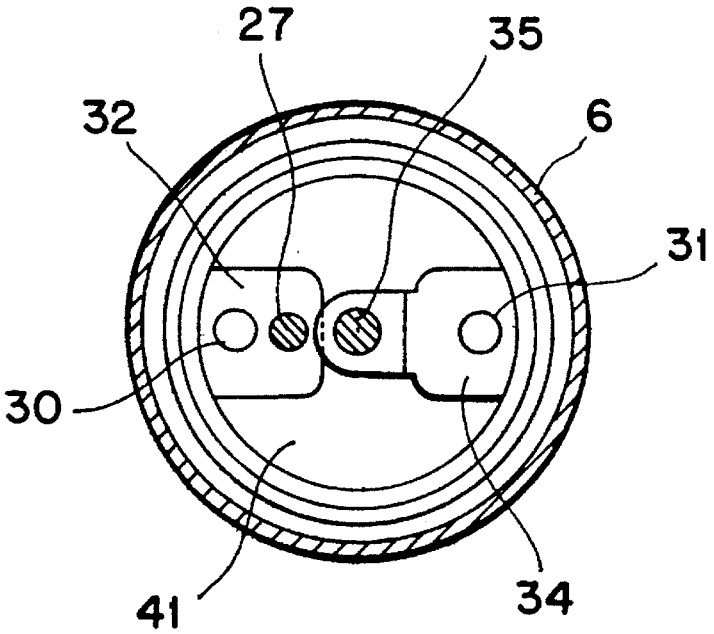
FIG. 4 is a sectional view taken along the line IV—IV of FIG. 3A.

Referring to FIGS. 2 to 4, there is shown a cathode support structure according to an embodiment of the invention. As shown in the drawings, a cylindrical anode 12 made of a copper plate etc., is provided at its inside wall with a plurality of radially disposed vanes 16 which divide the interior of the cylindrical anode into a plurality of resonators, and the cylindrical anode 12 and the vanes 16 constitute an anode structure. A working space is defined by the inner ends of the vanes 16 around an axis of the cylindrical anode 12. Disposed in the working space defined by the vanes 16 is filament cathode 1 made of thorium-tungsten alloy and coiled into a screw-shape for emitting thermions.

The coiled filament cathode I is fixed at its both ends to upper and lower end caps 2 and 3 for intercepting thermions emitting centrally of the filament cathode which result in current lost. An outer cathode support rod 27 is fused at its upper end to a bottom of the lower end cap 3, and a central cathode rod 35 is passed through a through hole formed in the lower end cap 3 and fused to the upper end cap 2.

In this case, the central cathode support rod 35 is passed through the lower end cap 3 and the filament cathode 1 without being in contact with them, and the outer and central cathode support rods 27 and 35 are made of molybdenum and are straight. The cathode support rods 27 and 35 are adapted to supply operating current.

A pair of funnel-shaped pole pieces 13 and 14 for concentrating a magnetic field uniformly through a magnetic field path into the working space are placed on inner circumferential cut away portions of the both ends of the cylindrical anode 12, and then the remaining outer circumferential portion of the cylindrical anode 12 is radially inwardly bent to hold the pole pieces 13 and 14. The pole pieces 13 and 14 held on the cylindrical anode 12 are then hermetically brazed in place.

A pair of metal sleeves 18 and 6 for sealing an interior of the cylindrical anode 12 are hermetically brazed to middle portions of the pole pieces 13 and 14 or both ends of the cylindrical anode 12, respectively. A pair of ring-shaped permanent magnets 20 and 21 are disposed around the metal sleeves 18 and 6 with predetermined spacings therebetween, respectively.

On an opening end of the metal sleeve 18 is fixedly mounted an output part ceramic cylinder 36 by means of a brazing etc. To an upper end of the output part ceramic cylinder 36 is fixed a metal exhaust tube 39. To a central portion of the metal exhaust tube 39 is fixed an output antenna lead 17 which extends between one of the vanes 16 and the metal exhaust tube 39 to extract a microwave power produced by the resonators. The metal exhaust tube 39 is covered with an output cap 37 serving as a high frequency antenna which serves to protect the brazed portion of metal exhaust tube 39, prevent spark generation by a concentration of electric field, and extract a high frequency output outside the metal exhaust tube.

A plurality of aluminum radiator fins 15 are radially disposed between the cylindrical anode 12 and a lower yoke **22*b* and fixed at inner ends thereof to an outer surface of the cylindrical anode 12 and coupled at outer ends thereof to the lower yoke 22*b* by a clamp member 24. The lower yoke 22*b* receiving the radiator fins 15 is closed by an upper yoke 22*a* with the ring-shaped permanent magnet 20 for forming the magnetic field path. Disposed between the output side permanent magnet 20 and the opening of the upper yoke 22*a*** are a first gasket 29 made of a metal network and a second gasket 38.

Lower ends of the outer and central cathode support rods 27 and 35 are passed through a conductive metal plate 32 and a conductive terminal plate 34 fixed to a ceramic stem 41 and fixedly inserted into holding holes 49 and 42 formed in the ceramic stem 61, respectively. The outer and central cathode support rods 27 and 35 are also electrically connected to first and second outer connecting leads 30 and 31 via the conductive metal plate 32 and the conductive terminal plate 34, respectively.

The ceramic stem 41 forming an essential part of the invention will be now described hereinafter.

As shown in FIGS. 3A to 4, the ceramic stem 41 has a cylindrical shape. The ceramic stem 41 has on its upper surface an annular groove 20*a* spaced from its outer circumference in order to ensure that the metal sleeve 6 is electrically insulated from the first and second connecting leads 30 and 31. The ceramic stem 41 is also formed at a center of the upper surface thereof with a holding hole 42 for holding the central cathode support rod 35 and, at a position between the holding hole 42 and the first outer connecting lead 30, with a holding hole 49 for holding the outer cathode support rod 27.

In this case, it should be noted that the holding hole 49 is formed on a diametrical line connecting the first and second outer connecting leads 30 and 31. On a circumference of an opening of the holding hole 42 is formed a counterbore 42*a* having a diameter lager than that of the holding hole 42 in order to ensure an insulation between the outer and central cathode support rods 27 and 35.

To the upper surface of the ceramic stem 41 between the annular groove 20*a* of the first outer connecting lead 30 side and the counterbore 42*a* of the holding hole 42 is applied a molybdenum-manganese paste layer (not shown) and then the conductive flat metal plate 32 is fixed thereagainst so that the outer cathode support rod 27 is electrically connected with the first outer connecting lead 30.

Applied to a portion of the upper surface of the stem 41 disposed radially opposite to the metal plate 32 and located between the annular groove 20*a* and the counterbore 42*a* of the holding hole 42 is a molybdenum-manganese paste layer (not shown) and fixed to that paste layer is the conductive terminal plate 34 so that the central cathode support rod 35 is electrically connected to the second outer connecting lead 35.

An inner portion of the conductive terminal plate 34 is upwardly bent so that such inner portion is spaced from the upper surface of the ceramic stem 41 by a distance "L". The inner portion of the conductive terminal plate 34 is also formed with a through hole for supporting the central cathode support rod 35.

Note specifically stated, the conductive terminal plate 34 is spaced from the upper surface of the ceramic stem 41 at its inner end to prevent a vibration of the cathode structure and is electrically connected to the central cathode support rod 35 to supply operating current to the filament cathode 1.

In the above description, the holding hole 42 for holding the central cathode support rod 35 has a depth deeper than that of the holding hole 49 to prevent a vibration of the cathode structure. Since the holding hole 42 for holding the central cathode support rod 35 and the holding hole 49 for holding the outer cathode support rod 27 are formed on a diametrical line between the through holes of the ceramic stem 41 in which the first and second outer connecting leads 30 and 31 are inserted, the first outer connecting lead 30, the outer cathode support rod 27, the central cathode support rod 35 and the second outer connecting lead 31 are aligned on the diametrical line of the ceramic stem 41 in this order from a left side to right side, as shown in FIG. 4.

The metal sleeve 6 is of course fixed to a circumference of the upper surface of the ceramic stem 41 with a molybdenum-manganese paste layer therebetween.

Figure 5:
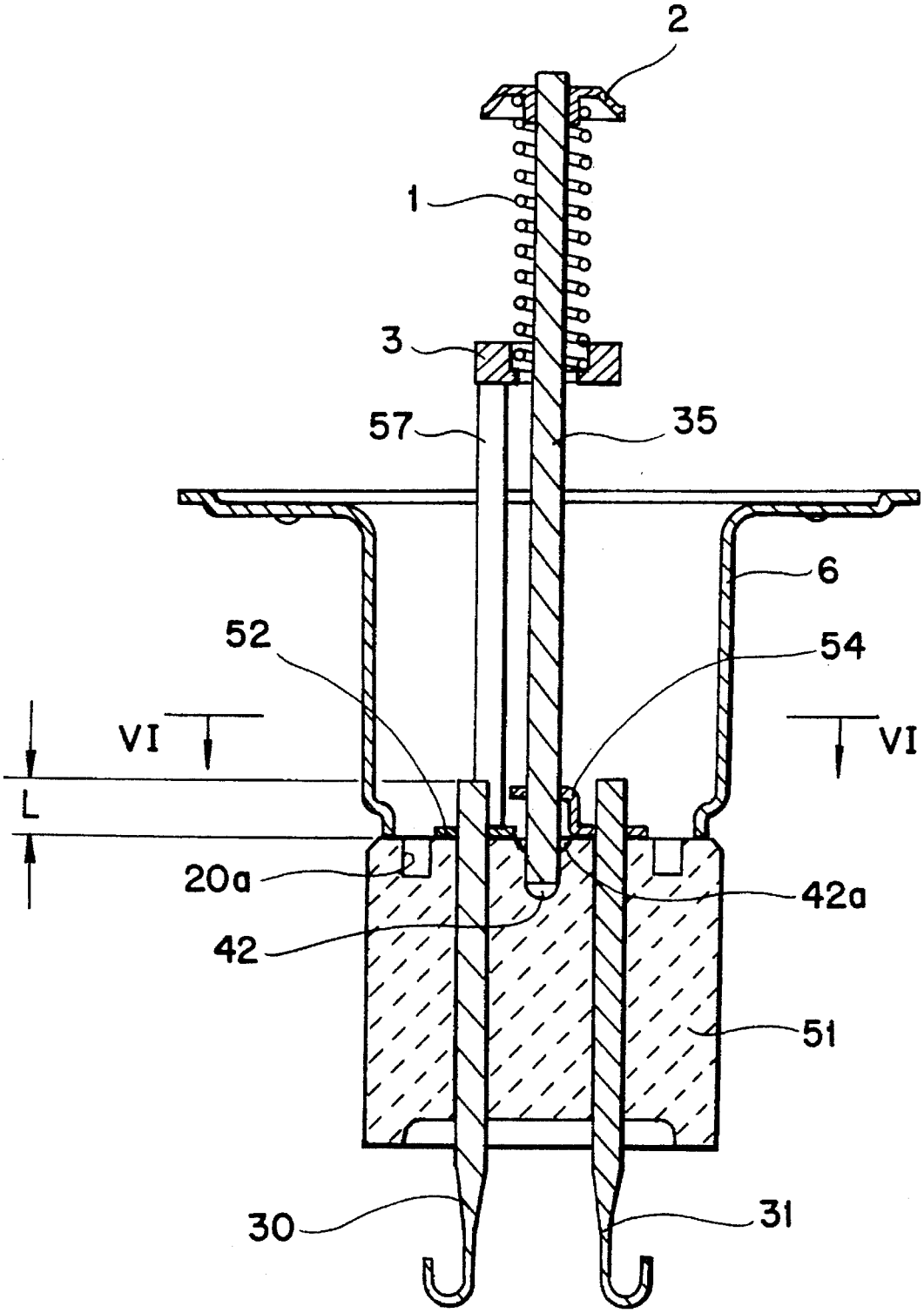
FIG. 5 is an enlarged sectional view of a cathode support structure for a magnetron according to another embodiment of the present invention.
Figure 6:
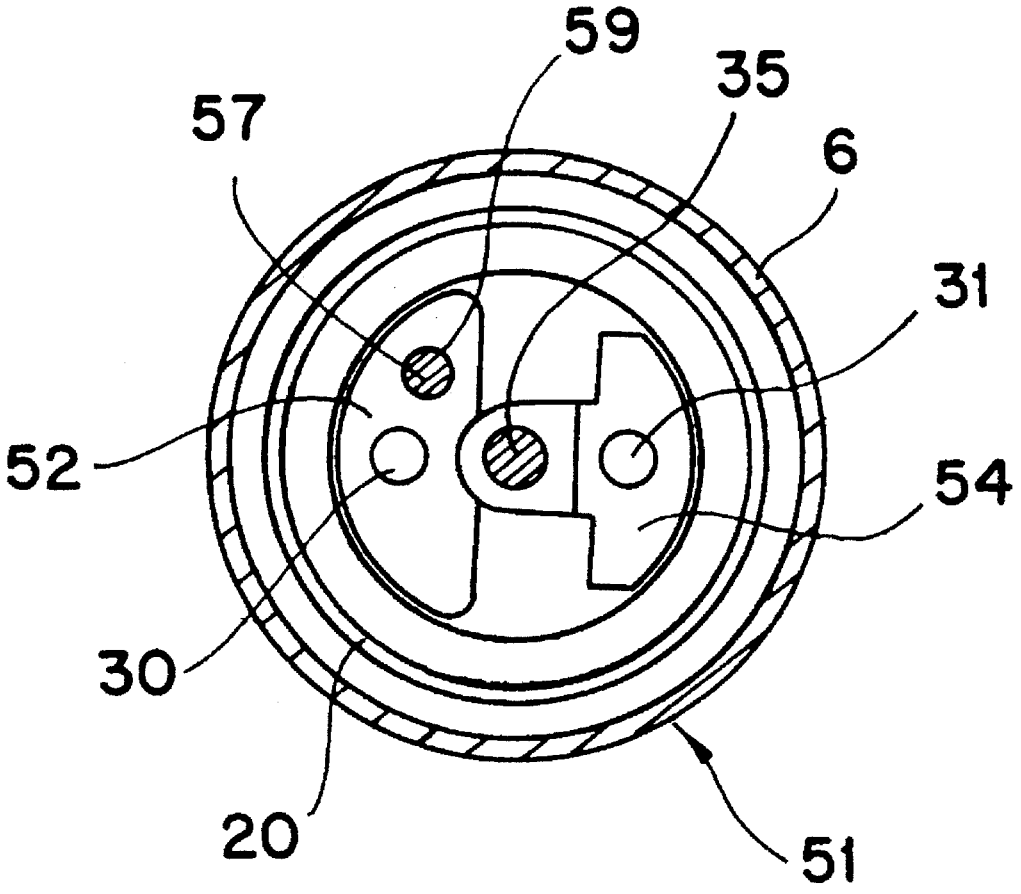
FIG. 6 is a sectional view taken along the line VI—VI of FIG. 5.

Referring to FIGS. 5 and 6, there are shown another embodiment of this invention. FIG. 5 shows a section of a cathode support, structure for a magnet,ton according to another embodiment of the invention and FIG. 6 shows a section taken along the line VI—VI of FIG. 5.

In this embodiment, it should be noted that applied to the upper surface of the ceramic stem 51 between the annular groove 20 of the first outer connecting lead 30 side and the counterbore 42*a* of the holding hole 42 is a molybdenum-manganese paste layer (not shown) and fixed thereagainst is a semicircular or a sector-shaped conductive flat metal plate 52 so that the outer cathode support, rod 57 is electrically connected with the first outer connecting lead 30.

It should be also noted that a holding hole 59 for holding an outer cathode support rod 57 is not positioned on a diametrical line connected between the first outer connecting lead 30, the central cathode support rod 35 and the second outer connecting lead 35 but rather is offset from the diametrical line, and a conductive terminal plate 54 is deformed in shape.

Accordingly, extra space is provided for assembling the outer cathode support rod 57, an assembling efficiency is increased. Since it is also easy to position the cathode structure on the central axis of the cylindrical anode 12, an efficiency and an output of the magnetron is increased and a production cost is reduced.

Operation of the above-constructed cathode support structure for a magnetron according to the invention will be now described hereinafter.

When outer current is applied to the magnetron through the outer connecting leads 30 and 31, a closed circuit is formed consisting of the second outer connecting lead 31, →the conductive terminal plate 54, →the central cathode support rod 35,→the upper end cap 2, →the filament cathode 1, →the lower end cap 3, →the outer cathode support rod 57,→the conductive metal plate 52,→the first outer connecting lead 30, so that the filament cathode 1 is applied with operating current to be heated. At this point, a predetermined voltage is supplied to the cylindrical anode 12 to cause the filament cathode 1 to emit thermions. The emitted thermions act in a magnetic field of the pole pieces 13 and 14 to carry out high frequency oscillation. The high frequency output is emitted into a microwave oven through the output antenna lead 17, the metal exhaust tube 39 and the output cap 37.

In the cathode support structure for a magnetron according to present invention, the outer and central cathode support rods 57 (or 27) and 35 extend vertically without having bent portions and are inserted into the holding holes 59 (or 39) and 42 formed on the ceramic stem 51 (or 41), respectively. Thus, the central cathode support rod 35 need not be bent at two positions of a middle portion thereof and the outer and central cathode support rods 57 (or 27) and 35 can be shortened, thereby causing the assembling operation of the cathode structure to be easy and a production cost to be reduced.

Also, since the outer and central cathode support rods 57 (or 27) and 35 are short and the holding hole 42 for receiving the central cathode rod 35 has a depth deeper than that of the holding hole 59 (or 39) for receiving the outer cathode support rod 57 (or 27), the central cathode support rod 35 is more firmly fixed in the holding hole 42.

In addition, since the central cathode support rod 35 is inserted into the through hole of the inner portion of the conductive terminal plate 54 (or 34) spaced from the upper surface of the ceramic stem 51 (or 41) by the distance "L" and electrically connected to the conductive terminal plate 54 (or 34) by using a brazing, the central cathode support rod 35 is precisely positioned and is more durable against a vibration.

As described above, since the straight central cathode support rod 35 need not be bent at its middle portion, a dimension error, which may occur during the bending operation, is prevented, and it is not necessary to adjust the position of the central cathode support rod 35 after assembly of the cathode structure.

Accordingly, the cathode structure is precisely positioned on an axis of the cylindrical anode 12, so that an efficiency and an output of the magnetron can be enhanced and a production cost can be reduced due to easiness of assembling operation.

As apparent from the above description, the cathode support structure for a magnetron of the invention is constructed as follows. The ceramic stem is formed with an annular groove at its upper surface and at a position spaced from the outer circumference of the ceramic stem and formed with the holding hole for fixing the central cathode support rod at the center of the upper surface and the holding hole for fixing the outer cathode support rod at a position between the central holding hole and the annular groove on the upper surface.

The central holding hole is formed with the counterbore at its opening circumference for the sake of insulation between the outer and central cathode support rods, thereby establishing an air gap at the shortest distance between the rod 35 and the plate 32 to resist vacuum discharge between the rod 35 and the plate 32.

The conductive metal plate is fixed to the upper surface of the ceramic stem between the annular groove and the central holding hole so that the first outer connecting lead is electrically connected to the outer cathode support rod.

The conductive terminal plate is fixed at its outer end to a position of the upper surface of the ceramic stem opposite to the metal plate and spaced from the metal plate so that the central cathode support rod is electrically connected to the second outer connecting lead. The conductive terminal plate is also bent upwardly at its inner end so that the inner end of the conductive terminal plate is spaced from the upper surface of the ceramic stem by a distance "L" to support the central cathode support rod firmly.

The outer and central cathode support rods are fixed in the outer and central holding holes via the through holes of the metal plate and the conductive terminal plate, respectively.

Therefore, since the central cathode support rod need not be bent at its middle portion, a correcting operation for a dimension error occurring in a bending of the central cathode support rod is not necessary. Since the outer and central cathode support rods made of expensive molybdenum are shortened, a production cost can be reduced. Also, the cathode structure can be precisely positioned on the axis of the cylindrical anode, so that an efficiency and an output of the magnetron are enhanced. Furthermore, since the central cathode support rod is additionally supported by the inner end of the conductive terminal plate spaced from the upper surface of the ceramic stem, the cathode structure can be considerably durable against vibration.

Having described specific preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A cathode structure for a magnetron comprising:

a ceramic stem including:

first and second end surfaces, a first holding hole extending through said first end surface generally at a center of said first end surface, a counterbore formed in said first end surface in surrounding relationship to said first holding hole such that said first holding hole extends into said stem farther than said counterbore, a second holding hole extending through said first end surface at a location offset from said first holding hole, an annular groove formed in said first end surface and surrounding said first and second holding holes, and first and second through-holes each extending through said stem from said first end surface to said second end surface, said first and second through-holes disposed to the outside of said first and second holding holes;

a first cathode support rod including first and second ends a second cathode support rod including first and second ends;

a first end cap affixed to said second end of said first cathode support rod and disposed in facing relationship to said first end surface;

a second end cap affixed to said second end of said second cathode support rod and situated closer to said first end surface than said first end cap, said second end cap including a recess through which said first cathode support rod passes;

a filament cathode extending between said first and second end caps and having said first cathode support rod passing therethrough;

first and second connecting leads extending through said first and second through-holes, respectively, from said first end surface to said second end surface;

a first conductive plate electrically interconnecting said first cathode support rod with said first connecting lead;

a second conductive plate fixed to said first end surface and interconnecting said second cathode support rod and said second connecting lead;

wherein the first end of said first cathode support rod is located within said first holding hole in spaced relationship to said first and second end surfaces, said second end of said first cathode support rod is spaced from said first end surface, said first cathode support rod extending linearly from its first end to its second end, said first cathode support rod passes through said second end cap and said filament cathode without contacting them;

said first end of said second cathode support rod being located within said second holding hole in spaced relationship to said first and second end surfaces, said second end of said second cathode support rod being spaced from said first end surface, said second cathode support rod extending linearly from its first end to its second end;

said first conductive plate having a first portion fixed to said first end surface, and a second portion spaced from said first end surface in a direction toward said end caps and connected to and supporting said first cathode support rod, said first conductive plate is fixed to said first end surface between said counterbore and said annular groove; and said second conductive plate is fixed to said first end surface between said counterbore and said annular groove and is in non-contacting relationship with said first conductive plate.

2. A cathode structure according to claim 1, wherein said first and second cathode support rods are formed of a molybdenum material.

3. A cathode structure according to claim 1, wherein said first and second cathode support rods lie on an imaginary line interconnecting said first and second connecting leads.

4. A cathode according to claim 1, wherein said first and second holding holes terminate at a location between said first and second end surfaces, said first holding hole being deeper than said second holding hole, said first end of said first cathode supporting rod extending deeper in said stem than said first end of said second cathode supporting rod.

5. A cathode structure according to claim 4, wherein said first holding hole lies along a center axis of said ceramic stem.

6. A cathode structure according to claim 1, wherein said second portion of said first conductive plate is oriented parallel to said first end surface and has a through-hole through which said first cathode support rod extends.

7. A cathode structure according to claim 1, wherein said second conductive plate has a semi-circular shape.

8. A cathode structure according to claim 1, wherein said first cathode support rod lies along an imaginary line intersecting said first and second connecting leads, said second cathode support rod being offset from said line.

9. A cathode structure according to claim 1, wherein said first and second connecting leads extend through said ceramic stem substantially parallel to said first and second cathode support rods.

* * * * *